US007249564B2

(12) United States Patent
Lissianski et al.

(10) Patent No.: US 7,249,564 B2
(45) Date of Patent: Jul. 31, 2007

(54) METHOD AND APPARATUS FOR UTILIZATION OF PARTIALLY GASIFIED COAL FOR MERCURY REMOVAL

(75) Inventors: Vitali Victor Lissianski, San Juan Capistrano, CA (US); Peter Martin Maly, Lake Forest, CA (US); William Randall Seeker, San Clemente, CA (US); Loc Ho, Sparks, NV (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/866,239

(22) Filed: Jun. 14, 2004

(65) Prior Publication Data

US 2005/0274307 A1 Dec. 15, 2005

(51) Int. Cl.
*F23J 15/00* (2006.01)

(52) U.S. Cl. ..... 110/345; 110/347; 110/203; 95/134

(58) Field of Classification Search ..... 110/342, 110/344, 345, 347, 204, 205, 206, 207, 233, 110/234; 48/210, 77, 197 R; 95/134; 423/230; 502/437

See application file for complete search history.

(56) References Cited

U.S. PATENT DOCUMENTS 4,196,173 A 4/1980 deJong et al.
4,233,274 A 11/1980 Allgulin
4,273,747 A 6/1981 Rasmussen
4,602,573 A * 7/1986 Tanca ..... 110/342
4,814,152 A 3/1989 Yan
4,843,102 A 6/1989 Horton
4,987,115 A 1/1991 Michel-Kim
5,141,724 A 8/1992 Audeh et al.
5,409,522 A 4/1995 Durham et al.
5,413,477 A 5/1995 Moreland
5,572,938 A 11/1996 Leger
5,695,726 A 12/1997 Lerner
5,787,823 A 8/1998 Knowles
6,027,551 A 2/2000 Hwang et al.
6,206,685 B1 3/2001 Zamansky et al.
6,280,695 B1 8/2001 Lissianski et al.
6,439,138 B1 * 8/2002 Teller et al. ..... 110/345
6,451,094 B1 9/2002 Chang et al.
6,471,506 B1 10/2002 Zamansky et al.
6,521,021 B1 2/2003 Pennline et al.
6,558,454 B1 5/2003 Chang et al.

(Continued)

OTHER PUBLICATIONS

"Kinetic Models For Predicting the Behavior Of Mercury In Coal-Fired Power Plants", C. Senior, et al., ACERC Annual Conference, Feb. 19-20, 2003, pp. 1-22.

(Continued)

*Primary Examiner*—Kenneth Rinehart
(74) *Attorney, Agent, or Firm*—Nixon & Vanderhye P.C.

(57) ABSTRACT

A method for capturing mercury in a flue gas formed by solid fuel combustion including: combusting coal, wherein mercury released during combustion is entrained in flue gas generated by the combustion; generating a thermally activated carbon-containing sorbent by partially gasifying a solid fuel in a gasifier local to the combustion of solid fuel; injecting the gasified gas products into the combustion of coal; injecting the thermally activated sorbent in the flue gas, and collecting the injected sorbent in a waste treatment system.

20 Claims, 3 Drawing Sheets

U.S. PATENT DOCUMENTS

| | | | | |
|---|---|---|---|---|
| 6,595,147 | B2 | 7/2003 | Teller et al. | |
| 6,604,474 | B2 | 8/2003 | Zamansky et al. | |
| 6,719,828 | B1 | 4/2004 | Lovell et al. | |
| 6,848,374 | B2 * | 2/2005 | Srinivasachar et al. | 110/345 |
| 2001/0041157 | A1 | 11/2001 | Spokoyny | |
| 2002/0029690 | A1 | 3/2002 | Ridgeway et al. | |
| 2002/0095866 | A1 | 7/2002 | Hassett | |
| 2002/0102189 | A1 | 8/2002 | Madden et al. | |
| 2002/0166484 | A1 | 11/2002 | Zamansky et al. | |
| 2002/0170431 | A1 | 11/2002 | Chang et al. | |
| 2003/0005634 | A1 | 1/2003 | Calderon et al. | |
| 2003/0009932 | A1 | 1/2003 | Kobayashi et al. | |
| 2003/0079606 | A1 | 5/2003 | Katz | |
| 2003/0091490 | A1 | 5/2003 | Nolan et al. | |
| 2003/0091948 | A1 | 5/2003 | Bool, III et al. | |
| 2003/0099912 | A1 | 5/2003 | Kobayashi et al. | |
| 2003/0099913 | A1 | 5/2003 | Kobayashi et al. | |
| 2003/0104328 | A1 | 6/2003 | Kobayashi et al. | |
| 2003/0104937 | A1 | 6/2003 | Sinha | |
| 2003/0108470 | A1 | 6/2003 | Spencer et al. | |
| 2003/0108833 | A1 | 6/2003 | Kobayashi et al. | |
| 2003/0110994 | A1 | 6/2003 | Lissianski et al. | |
| 2003/0143128 | A1 | 7/2003 | Lanier et al. | |
| 2003/0147793 | A1 | 8/2003 | Breen et al. | |
| 2003/0154858 | A1 | 8/2003 | Kleut et al. | |
| 2003/0185718 | A1 | 10/2003 | Sellakumar | |
| 2004/0011057 | A1 | 1/2004 | Huber | |

OTHER PUBLICATIONS

"Evaluating The Effects of Low-NOx Retrofits on Carbon In Ash Levels[1]", K.A. Davis, et al. Presented at the Mega Symposium: EPRI-DOE-EPA Combined Utility Air Pollutant Control Symposium, Atlanta, GA, Aug. 1999, pp. 1-15.

"Behavior of Mercury In Air Pollution Control Devices on Coal-Fired Utility Boilers[1]" Constance L. Senior, Prepared For Power Production in the 21st Century: Impacts of Fuel Quality and Operations, Engineering Foundation Conference, Snowbird, UT, Oct. 28-Nov. 2, 2001, pp. 1-17.

"Loss On Ignition In Coal Combustion Simulations", Stefan P. Domino et al., pp. 1-49 (1999).

Reaction Engineering International brochure "Furnace Performance", Reaction Engineering International, printed from REI website on Aug. 22, 2003, pp. 1-2.

"Comparison of Photoacoustic Methods To Loss-On-Ignition and Foam Index Tests In Fly Ash Evaluations", Robert Novack, et al., pp. 1-2 (1997).

"Combustion Optimization Using MPV Systems", Mark Khesin, et al., Pittsburgh Coal Conference, Sep. 2000, pp. 1-4.

"Reburn Systems", GE Power Systems, Air Quality Systems & Services, pp. 1-3, GEA-13207 (2001).

"FlamemastEER™ Low $NO_x$ Burners", GEA-13132, p. 1, printed Dec. 2003.

"$NO_x$ Control for Gas Turbines", GE Power Systems, pp. 1-2, printed Dec. 17, 2003.

"$NO_x$ Control for Boilers", GE Power Systems, pp. 1-2, printed Dec. 17, 2003.

"Coalogic™", GE Power Systems, pp. 1-2, printed Dec. 17, 2003.

"Coal Balancing & Blending", GE Power Systems, pp. 1-2, printed Dec. 17, 2003.

"$NO_x$ Reduction", Hamon, pp. 1-2, Dec. 8, 2003.

"Selective Catalytic Reduction (SCR)", Hamon, pp. 1-2, printed Dec. 8, 2003.

"Selective Non-Catalytic Reduction (SNCR)", Hamon, pp. 1-3, printed Dec. 8, 2003.

"SCR SNCR Hybrid System", Hamon, pp. 1-2, Dec. 8, 2003.

"Evaluation of the Effect of SCR NOx Control Technology on Mercury Speciation", Feeley, III et al., Mar. 2003, pp. 1-11.

John H. Pavlish et al., "Status Review Of Mercury Control Options For Coal-Fired Power Plants", pp. 89-165, Fuel Processing Technology 82 (2003).

Thomas D. Brown et al., "Mercury Measurement And Its Control: What We Know, Have Learned, and Need To Further Investigate", Journal of the Air & Waste Management Association, pp. 628-640, vol. 49, Jun. 1999.

Blair A. Folsom et al, "Combustion Modification—An Economic Alternative for Boiler $NO_x$ Control", GE Power Systems, GER-4192, pp. 1-8, Apr. 2001.

R. Sehgal et al., "Intelligent Optimization of Coal Burning to Meet Demanding Power Loads, Emission Requirements, and Cost Objectives", GE Power Systems, GER-4198, pp. 1-14, Oct. 2000.

The Washington Post, "Limiting Mercury Pollution Is Focus of Hot Debate", pp. A3, Mar. 15, 2004.

British Search Report for GB 0511869.0 dated Sep. 7, 2005.

* cited by examiner

METHOD AND APPARATUS FOR UTILIZATION OF PARTIALLY GASIFIED COAL FOR MERCURY REMOVAL

BACKGROUND OF THE INVENTION

This invention relates to the combustion of coal and in particular to the generation of sorbents to capture mercury (Hg) in flue gas generated during coal combustion.

Emissions from coal combustion may contain volatile metals such as mercury (Hg). There is a long felt need to reduce Hg in gaseous emissions from coal-fired boilers and other industrial coal combustion systems. As mercury volatizes during coal combustion, it enters the flue gas generated by combustion. Some of the volatized mercury can be captured by injected sorbents and removed via a particulate collection system. If not captured, the mercury may pass into the atmosphere with the stack gases from the coil boiler. Mercury is a pollutant. Accordingly, it is desirable to capture a much mercury in flue gas before the stack discharge.

Injection of activated carbon as a sorbent that captures mercury in the flue gas is a known technology for Hg control. See e.g., Pavish et al., "Status review of mercury control options for coal-fired power plants" Fuel Processing Technology 82, pp. 89-165 (2003). Depending on coal type and the specific configuration of the emission control system, e.g., injection ahead of a particulate collector or a compact baghouse added behind an existing electrostatic particulate control device ESP, and coal type, the efficiency of Hg removal by activated carbon injection ranges from 60% to 90%.

The cost of Hg control in coal-fired power plants using activated carbon tends to be expensive. See e.g., Brown et al., "Control of Mercury Emissions from Coal-Fired Power Plants: A Preliminary Cost Assessment and the Next Steps for Accurately Assessing Control Costs", Fuel Processing Technology 65-66, pp. 311-341 (2000). The typical cost for mercury removal using activated carbon injection generally ranges $20,000 per pound (lb.) of removed mercury to $70,000/lb of Hg. This cost is dominated by the cost of the sorbent. Accordingly there is a long felt need for an economical way to produce activated carbon sorbents. By reducing the cost of sorbents, the cost of removing mercury from flue gas may be substantially reduced.

BRIEF DESCRIPTION OF THE INVENTION

The invention may be embodied as a method for capturing mercury in a flue gas formed by solid fuel combustion including: combusting coal, wherein mercury released during combustion is entrained in flue gas generated by the combustion; generating a thermally activated carbon-containing sorbent by partially gasifying a solid fuel in a gasifier local to the combustion of solid fuel; injecting the gasified solid fuel into the combustion of coal; injecting the thermally activated sorbent in the flue gas, and collecting the injected sorbent in a waste treatment system.

In addition, another embodiment of the invention is a method for capturing mercury in a flue gas formed by solid fuel combustion comprising: combusting a solid fuel in a furnace or boiler, wherein mercury released during combustion is entrained in flue gas generated by the combustion and flows to a waste treatment system; generating a thermally activated carbon-containing sorbent by partially gasifying a carbon solid fuel in a gasifier local to the furnace or boiler; injecting gasifier fuel from the gasifier into the furnace or boiler; injecting the thermally activated sorbent in a flue gas duct of the waste treatment system; capturing at least some of the entrained mercury with the injected sorbent; collecting the injected sorbent with the mercury in the waste treatment system.

The invention may also be embodied as a system for capturing mercury from flue gas comprising: a furnace or boiler arranged to receive coal and air and further comprising a coal and air injection system, and a combustion zone for combusting the coal and air; a waste treatment system connected to receive flue gas generated in the combustion of the furnace or boiler, wherein said waste treatment system includes a sorbent injector and a sorbent collection device; a sorbent generator further comprising a gasifier having an inlet for a solid carbon fuel, a gasification chamber within which the solid carbon fuel is at least partially combusted to generate sorbent and gasified fuel; a conduit between the gasifier and sorbent injector to convey the sorbent to the injector, and a conduit between the gasifier and the coal and air injection system to convey the gasified fuel to the injection system.

DETAILED DESCRIPTION OF THE INVENTION

Carbon-based sorbents are effective in removing mercury from flue gas. A system and method have been developed to produce thermally activated mercury sorbent by partially gasifying coal or other carbon containing fuel in a gasifier. The thermally activated sorbent may be injected into mercury containing flue gas upstream of an existing particulate control device (PCD) or downstream of the PCD if there exists a downstream particulate control system dedicated to the sorbent. Thermally activated sorbent is produced from the same coal as fired at the plant or from other carbon containing solid fuel.

The current system and method decrease mercury emissions from the stack of coal-fired boilers by injecting locally generated thermally activated carbon-based sorbent into flue gas and absorbing mercury from the flue gas on the sorbent. Advantages of this method in comparison to traditional activated carbon injection include (without limitation): low capital cost for equipment required to produce thermally activated sorbent; reduced need for a silo to store activated carbon, and relatively low cost of sorbent production.

Figure 1:
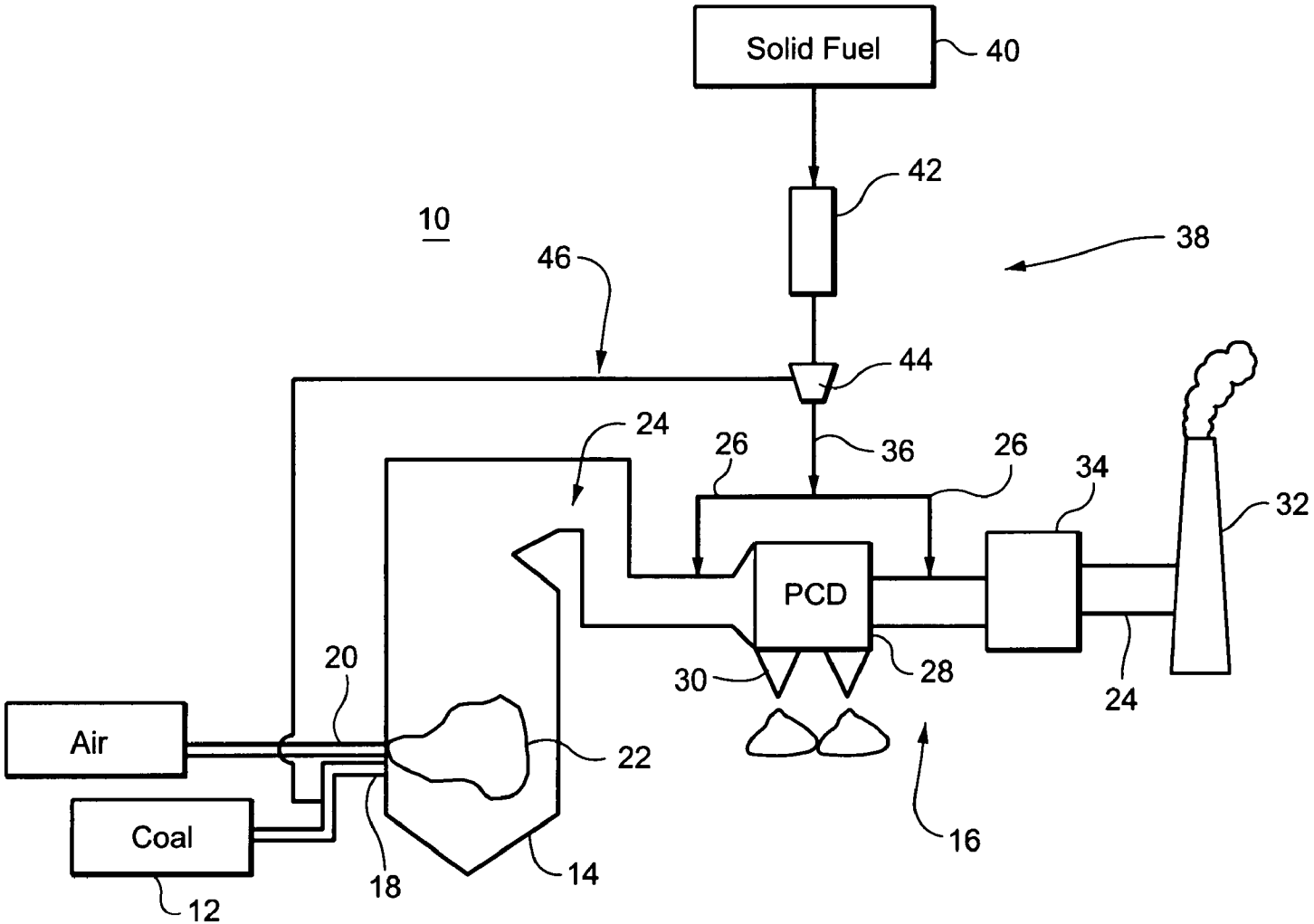
FIG. 1 is a schematic diagram of a coal fired furnace having a gasifier for producing sorbent, and particulate and sorbent control devices.

FIG. 1 shows a coal-fired power plant 10 comprising a supply of coal 12, a boiler 14 and a combustion waste treatment system 16. The boiler includes a solid fuel injection system 18 and air injectors 20. The coal and air mixture burn in a combustion zone 22 within the boiler. Flue gases generated in the combustion zone may contain mercury released from the coal during combustion.

The flue gas flows through the boiler and into the ducts 24 of the waste treatment system where the flue gas cools. The waste treatment system 16 includes a sorbent injection system 26, a particulate control device (PCD) 28 with an ash discharged 30, and a stack 32 for flue gas discharge. The sorbent injection system may inject sorbent into the duct 24 upstream of the PCD. In addition (or alternatively) the sorbent may be injected downstream of the PCD if a dedicated sorbent particulate collection device 34 is included in the waste treatment system 16.

The sorbent flows from a sorbent discharge chute 36 from a sorbent generator 38. In the generator, coal or other carbon containing solid fuel 40 is partially gasified in a gasifier 42 that produces thermally activated carbon sorbent. The gasifier may discharge the sorbent along with the gases into the duct 24 through chute 36. Alternatively, the thermally activated solid sorbent generated in the gasifier is separated from the other gasification products in a cyclone separator 44. A mixture of sorbent and gaseous fuel products enter the inlet of the cyclone separator 44. The solid particles of sorbent are discharged from the cyclone into the sorbent chute 36. The gasifier and cyclone may be on site with the waste treatment system 16. The gaseous products from the gasifier flow through a conduit 46 to the coal injectors 18 and flow into combustion zone 22 in the boiler.

Figure 2:
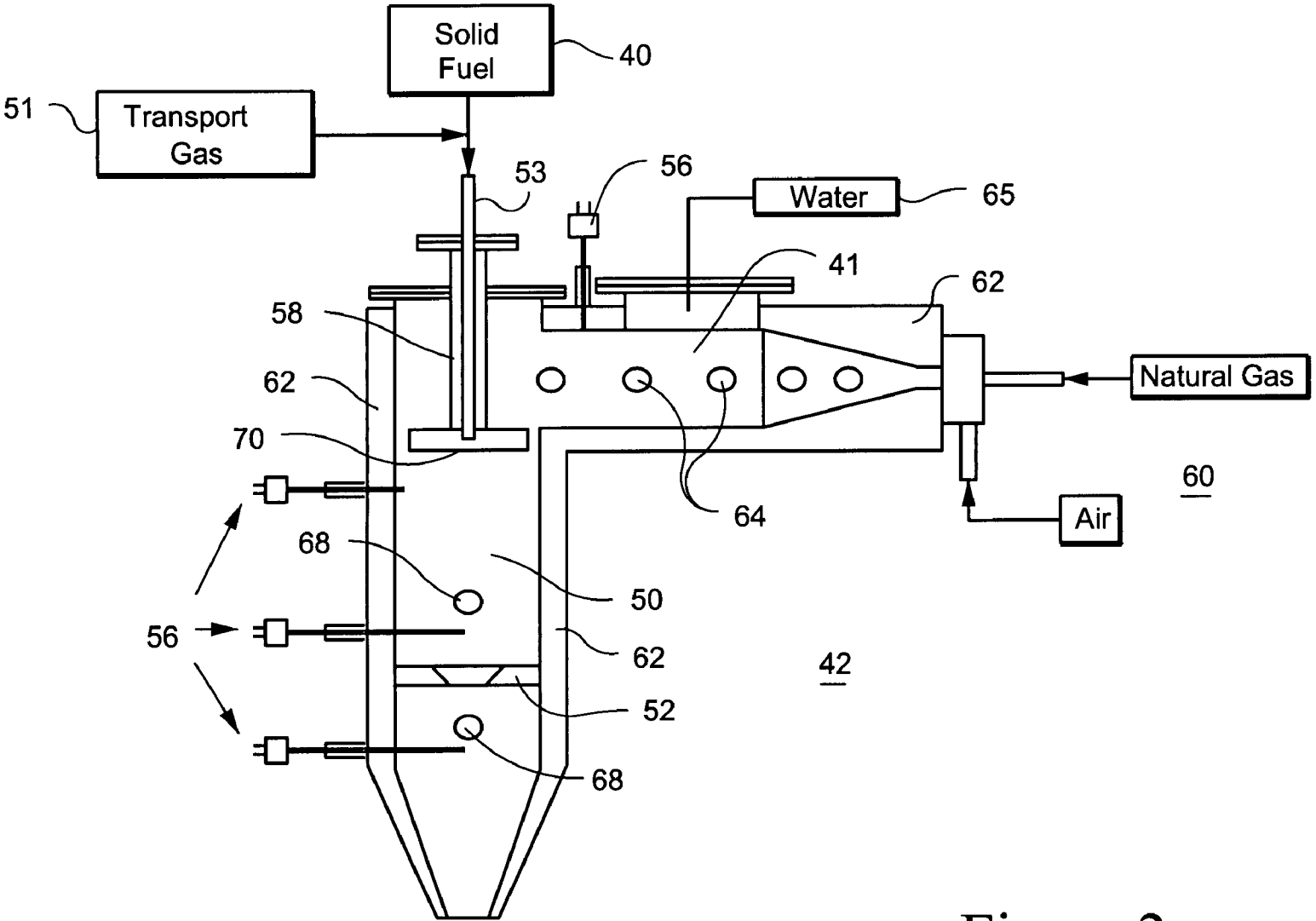
FIG. 2 is a side view of an exemplary solid fuel gasifier shown in cross-section.

FIG. 2 shows schematically and in cross-section a solid fuel gasifier 42, which may be a conventional device. The gasifier includes a vertical gasification chamber 50 into which solid fuel particles 40 and heat are injected. The combustion of the fuel particles in the gasification chamber 50 produces sorbent and gasified fuel. The solid fuel for sorbent combustion may be coal, biomass, sewage sludge, waste product or other carbon containing solid fuels. A choke 52 arranged in the gasification chamber 50 regulates the residence time of the fuel within the chamber. A residence time of 0.5 to 10 seconds in the gasifier chamber is generally preferable for generating sorbent. Thermocouples 56 are arranged in the gasification chamber 50 and heating chamber 41 monitor the temperature in these chambers.

In one example, the gasifier 42 may be formed from stainless steel and its inner walls are refractory lined. Heat required for solid fuel gasification is supplied by the combustion of natural gas and air. The horizontally aligned heating chamber 41 may have an internal diameter of 8 inches (in.). Coal 40 is injected into the gasification chamber 50, which may have internal diameter of 12 in. Nitrogen or air may be used as a transport media for the solid fuel.

The solid fuel 40 is injected at an upper end of the gasification chamber 50 through an water jacketed injector 58. A transport gas 51 is injected through the fuel injector 53 to carry the solid fuel particles into the gasification chamber 50. The heat added to the gasification chamber causes the solid fuel particles to partially gasify, e.g., by partial combustion, and to generate reactive sorbent particles. The walls of the gasification chamber 50 and the auxiliary heat chamber 41 are refractory lined 62 to accommodate the heat within the heating chamber.

Heat required for partial gasification of the solid fuel, e.g., coal, is provided by a heat source 60 and/or by partially combusting the solid fuel in the gasifier. For example, natural gas and air 60 are mixed in the heat chamber 41 to generate heat that is provided to the gasification chamber 50. Cooling ports 64 in the heat chamber allow water 66 to cool the walls of the heat chamber and solid fuel injector 58. The cooling of the heating chamber 41 allows the temperature to be controlled and avoid excessive combustion of the solid fuel in the gasification chamber 50. The temperature in the gasification chamber is preferably in a range of 1000 degree to 2000 degrees Fahrenheit.

Conditions in the gasification chamber 50 are optimized to enhance the generation thermally activated sorbent having relatively high reactivity. For example, the sorbent may be produced to have a relatively large surface area and high carbon content. Process parameters in the gasifier include fuel residence time in the gasification chamber 50, the stoichiometric ratio (SR) of carbon containing material to air, and the temperature in the chamber 50. By controlling these process parameters, the generation of reactive sorbent can be enhanced. Optimum process conditions in the gasifier are also affected by the type of carbon containing fuel 40 and its reactivity.

Tests were conducted to determine the effect of gasifier parameters on the reactivity of the thermally activated carbon-containing sorbent. Sorbent reactivity may be viewed as the carbon content in the sorbent.

The temperature profile in the gasification chamber 50 was measured using several thermocouples 56 located along the chamber wall and in the heating chamber 41. Ports 68 located near in the gasification chamber allowed for gas and solid samples to be taken and analyzed. Solid samples were analyzed to determine loss-on-ignition (LOI), which provides a measure of the carbon present.

Figure 3:
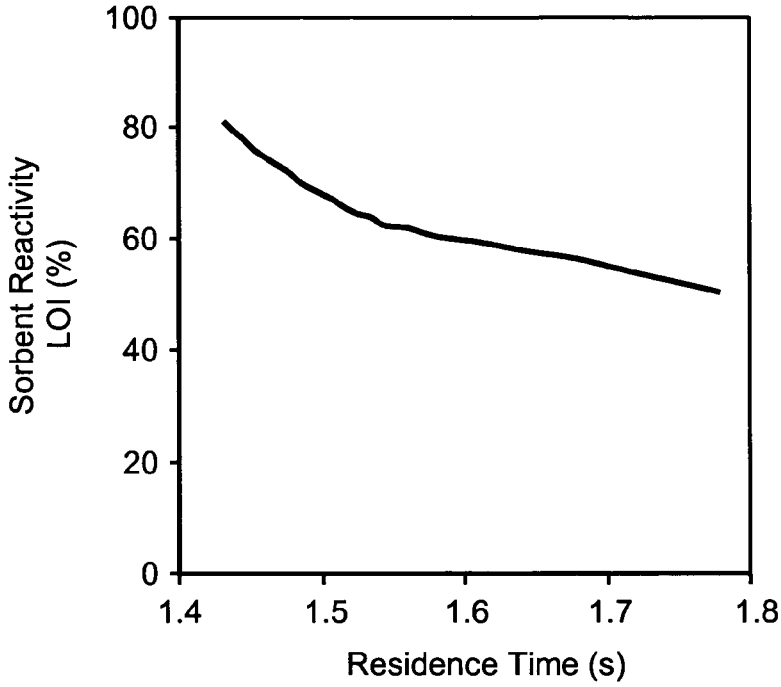
FIG. 3 is a chart showing test data regarding the effect of gasifier residence time on carbon content in the sorbent.
Figure 4:
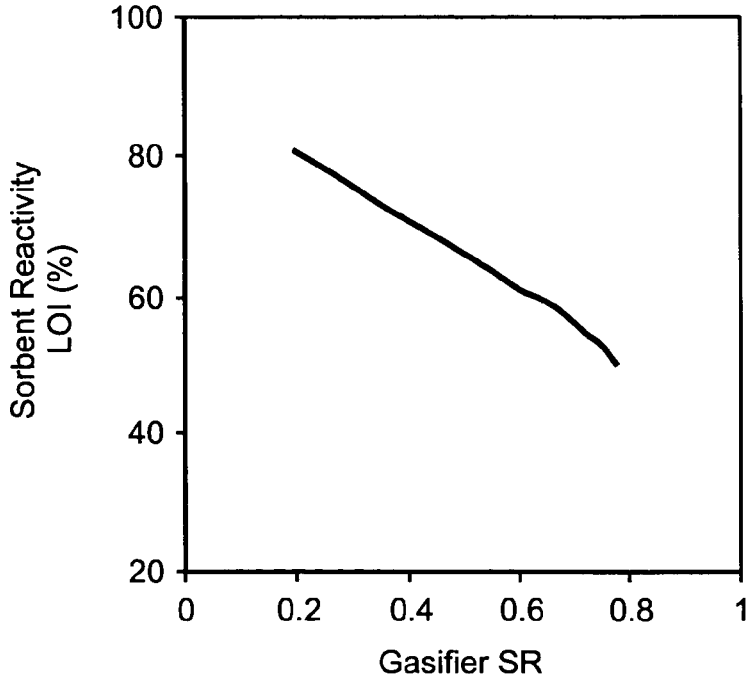
FIG. 4 is a chart showing test data regarding the carbon content in sorbent with respect to the stoichiometric ratio in a gasification zone.

FIGS. 3 and 4 are charts of test data showing the effects of the residence time and stoichiometric ratio (SR) in the gasification chamber 50 on the carbon content in the sorbent. Gasifier SR was varied by changing the amount of coal 40 and by changing the gas carrier from air to nitrogen. Moving the tip 70 of the coal injector 51 deeper into the gasification zone varied residence time. FIGS. 3 and 4 demonstrate that the extent of gasification increases as residence time and SR increase. To optimize sorbent production, the residence time and SR should not be excessive.

It is desirable to have thermally activated sorbent with higher carbon content. Thus, short residence times and lower SR favor high carbon content in the sorbent. On the other hand, the extent of coal gasification at very short residence times results in relatively small surface area of the sorbent. Sorbent particles having large surface areas are effective at capturing mercury. Thus, conditions in the gasifier have to be optimized to achieve high reactivity of the sorbent.

As shown in FIG. 3, the reactivity (LOI) of the sorbent decreases slightly as the residence time within the gasification chamber 50 increases. For example, a residence time of 1.4 to 10 seconds ensures that the loss-on-ignition (LOI) remains relatively high. The LOI provides an indication of the amount of carbon sorbent formed in the gasification chamber. A residence time of 1.4 to 10 seconds has been found to enhance the generation of sorbent. The data presented in FIG. 4 indicates that a relatively high stoichiometric ratio (SR) of the solid fuel to available air increases the LOI and thus the amount of sorbent. Maintaining the SR in a range of 0.1 to 1.0 has been found to produce a good reactive sorbent.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method for capturing mercury in a flue gas formed by solid fuel combustion comprising:

a. combusting a coal fuel in a combustion zone of a combustion system, wherein mercury released during combustion is entrained in flue gas generated by the combustion;

b. generating a thermally activated carbon-containig solid sorbent and gaseous gasification products by partially gasifying a carbon solid fuel in a gasifier local to the combustion of solid fuel, wherein the gasifier is separate from the combustion system and the flue gas, and wherein the gasifier receives the carbon solid fuel, combusts the carbon solid fuel and generate the solid sorbent in the gasifier;

c. separating the solid sorbent from the gaseous gasification products generated by the gasifier;

d. the solid sorbent generated in the gasifier flows continuously and without interruption from the gasifier thruough a conduit to the flue gas;

e. injecting the thermally activated solid sorbent in the flue gas and downstream of the combustion of fuel, and f. absorbing at least some of the mercury on the thermally activated solid sorbent, wherein the thermally activated solid sorbent is separate ed from gaseous gasification products prior to injection, and wherein the gaseous gasification products are injected into the combustion zone, which is upstream of the injection of the solid sorbent.

2. The method of claim 1 wherein the thermally activated sorbent is produced from at least one of coal, biomass, sewage sludge and a carbon containing waste product.

3. The method of claim 1 wherein a temperature in the gasifier is in a range of about 1000 to about 2000 degrees Fahrenheit.

4. The method of claim 1 wherein a fuel residence time in the gasifier in a range of about 0.5 to about 10 seconds.

5. The method of claim 1 wherein a stoichiometric ratio in the gasifier is in the range of about 0.1 to about 1.0.

6. The method in claim 1 wherein the solid sorbent is generated on site of a waste treatment system coupled to the combustion system.

7. The method in claim 1 wherein the solid sorbent is injected in the flue gas up stream of a particulate control device, and said method further comprises collecting the solid sorbent with captured mercury in the particulate control device.

8. The method in claim 1 wherein the sorbent is injected in the flue gas downstream of a particulate control device, and said method further comprises collecting the solid sorbent with captured mercury in a sorbent collection device.

9. The method in claim 1 further comprising collecting the injected solid sorbent in a waste treatment system.

10. A method for capturing mercury in a flue gas formed by solid fuel combustion comprising:

a. combusting a solid coal fuel in a combustion zone of a furnace or boiler, wherein mercury released during combustion is entrained in flue gas generated by the combustion and flows to a waste treatment system;

b. generating a thermally activated carbon-containing solid sorbent and gaseous gasification products by partially gasifying a carbon solid fuel in a gasifier local to the furnace or boiler, wherein the gasifier is separate from the combustion system and the flue gas, and wherein the gasifier receives the carbon solid fuel, combusts the carbon solid fuel and generates the solid sorbent in the gasifier;

c. separating the solid sorbent from the gaseous gasification products generated by the gasifier before the solid sorbent flows into the flue gas;

d. injecting the gaseous gasification product into the combustion zone;

e. the solid sorbent generated in the gasifier flows continuously and without interruption from the gasifier through a conduit to the flue gas;

f. injecting the thermally activated solid sorbent in a flue gas duct of the waste treatment system and downstream of the combustion zone, and g. capturing at least some of the entrained mercury with the injected solid sorbent.

11. The method of claim 10 wherein the thermally activated solid sorbent is produced from at least one of coal, biomass, sewage sludge and a carbon containing waste product.

12. The method of claim 10 wherein a temperature in the gasifier is in a range of about 1000 to about 2000 degrees Fahrenheit.

13. The method of claim 10 wherein a fuel residence time in the gasifier in a range of about 0.5 to about 10 seconds.

14. The method of claim 10 wherein a stoichiometric ratio in the gasifier is in the range of about 0.1 to about 1.0.

15. The method in claim 10 wherein the solid sorbent is generated on site of the waste treatment system.

16. The method in claim 10 wherein the solid sorbent is injected in the flue gas up stream of a particulate control device and the solid sorbent with captured mercury is collected in the particulate control device.

17. The method in claim 10 wherein the waste treatment system further comprises a particulate control device and a sorbent collection device, and said method further comprises injecting the solid sorbent in the flue gas downstream of the particulate control device and collecting the solid sorbent with captured mercury in the sorbent collection device.

18. The method in claim 10 further comprising collecting the injected solid sorbent with the mercury in a waste treatment system.

19. A system for capturing mercury from flue gas comprising:

a furnace or boiler arranged to receive coal and air and further comprising a coal and air injection system, and a combustion zone for combusting the coal and air;

a waste treatment system connected to receive flue gas generated in the combustion zone, wherein said waste treatment system further comprises a solid sorbent injector and a solid sorbent collection device;

a solid sorbent generator further comprising a gasifier having an inlet for a solid carbon fuel, a gasification chamber within which the solid carbon fuel is at least partially combusted to generate solid sorbent and gasified gas products, wherein the gasification chamber is separate from the combustion zone and from flue gas generated by the combustion zone, and wherein the gasifier receives the solid carbon fuel, combusts the solid carbon fuel and generates the solid sorbent in the gasifier, and a conduit between the gasifier and solid sorbent injector to continuously and without interruption convey the solid sorbent to the injector, wherein the conduit includes a solids separator that separates the solid sorbent from the gasified gas products.

20. A system as in claim 19 further comprising a cyclone separator coupled to a discharge port of the gasifier, and having a solid sorbent discharge coupled to the conduit between the gasifier and solid sorbent injection and a gas discharge coupled to the conduit between the gasifier and the coal and air injection system.

* * * * *

UNITED STATES PATENT AND TRADEMARK OFFICE

CERTIFICATE OF CORRECTION

PATENT NO. : 7,249,564 B2
APPLICATION NO. : 10/866239
DATED : July 31, 2007
INVENTOR(S) : Vitali Lissianski et al.

It is certified that error appears in the above-identified patent and that said Letters Patent is hereby corrected as shown below:

At column 4 line 63 change the word “containig” to --containing--

At column 5 line 2 change the word “generate” to --generates--

At column 5 line 8 change the word “through” to --through--

At column 5 lines 13-14 change the phrase “separate ed” to --separated--

Signed and Sealed this

Thirteenth Day of November, 2007

JON W. DUDAS
*Director of the United States Patent and Trademark Office*